US009196436B2

(12) United States Patent
Lee

(10) Patent No.: US 9,196,436 B2
(45) Date of Patent: Nov. 24, 2015

(54) RING MAIN UNIT CIRCUIT BREAKER EQUIPPED WITH CONTACT FORCE CONTROLLER

(71) Applicant: LSIS CO., LTD., Anyang-si, Gyeonggi-do (KR)

(72) Inventor: Dong Sik Lee, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/190,632

(22) Filed: Feb. 26, 2014

(65) Prior Publication Data

US 2015/0060248 A1 Mar. 5, 2015

(30) Foreign Application Priority Data

Aug. 29, 2013 (KR) ..... 10-2013-0103395

(51) Int. Cl.

| | |
|---|---|
| ***H01H 3/46*** | (2006.01) |
| ***H01H 19/02*** | (2006.01) |
| ***H01H 33/666*** | (2006.01) |
| *H01H 3/42* | (2006.01) |
| *H01H 3/32* | (2006.01) |

(52) U.S. Cl.

CPC ..... *H01H 19/02* (2013.01); *H01H 33/666* (2013.01); *H01H 3/42* (2013.01); *H01H 2003/323* (2013.01)

(58) Field of Classification Search

CPC . H01H 33/666; H01H 3/3015; H01H 9/0027; H01H 2003/323; H01H 3/46

See application file for complete search history.

(56) References Cited

U.S. PATENT DOCUMENTS

| | | | | |
|---|---|---|---|---|
| 7,098,418 | B1 * | 8/2006 | Yamada et al. | 218/120 |
| 2013/0187733 | A1 * | 7/2013 | Bullock et al. | 335/13 |
| 2014/0043119 | A1 * | 2/2014 | Bullock et al. | 335/202 |

FOREIGN PATENT DOCUMENTS

| | | |
|---|---|---|
| KR | 10-1119734 | 4/2012 |
| KR | 20-0468495 | 8/2013 |

OTHER PUBLICATIONS

Korean Intellectual Property Office Application Serial No. 10-2013-0103395, Notice of Allowance dated Nov. 21, 2014, 2 pages.

* cited by examiner

*Primary Examiner* — Truc Nguyen

(74) *Attorney, Agent, or Firm* — Lee, Hong, Degerman, Kang & Waimey

(57) ABSTRACT

The present invention relates to a ring main unit circuit breaker equipped with a contact force controller, and particularly, to a ring main unit circuit breaker equipped with a contact force controller, capable of controlling a contact force between contacts of a vacuum interrupter, by controlling an interval between the contacts, through a simple manual operation from outside, without having a disassembly operation.

3 Claims, 8 Drawing Sheets

(a)

(b)

RING MAIN UNIT CIRCUIT BREAKER EQUIPPED WITH CONTACT FORCE CONTROLLER

CROSS-REFERENCE TO RELATED APPLICATION

Pursuant to 35 U.S.C. §119(a), this application claims the benefit of earlier filing date and right of priority to Korean Application No. 10-2013-0103395, filed on Aug. 29, 2013, the contents of which is incorporated by reference herein in its entirety.

BACKGROUND OF THE DISCLOSURE

1. Field of the Disclosure

The present invention relates to a ring main unit circuit breaker equipped with a contact force controller, and particularly, to a ring main unit circuit breaker equipped with a contact force controller, capable of controlling a contact force between contacts of a vacuum interrupter, by controlling an interval between the contacts through a simple manual operation from outside, without having a disassembly operation.

2. Background of the Disclosure

Generally, a ring main unit (RMU) is a device configured to monitor, control and protect an electric system used when distributing power received from an electric power substation to consumers. The ring main unit is configured as an assembly which includes a circuit breaker, a switchgear, a ground switch, conducting lines, etc. in an enclosure insulated by $SF_6$.

The circuit breaker of the ring main unit is generally provided with a vacuum interrupter. The vacuum interrupter is provided with a movable electrode and a fixed electrode which form a fixed contact and a movable contact contactable to or separable from each other. As a closing operation and an opening operation of the circuit breaker are repeatedly performed in an installation step and a usage step, the fixed contact and movable contact are pressed to thus be contracted. As the fixed contact and the movable contact are contracted, an interval between the contacts is increased. In this case, a contact force applied to the contacts may be decreased, and a contact failure may occur to cause an accident. Accordingly, the increased interval between the contacts should be restored to a normal state. In the conventional art, has been used a method for compensating a contact force by disassembling a circuit breaker, by upward-moving a fixed electrode of a vacuum interrupter using a spacer, and then by re-assembling the circuit breaker. However, such method requires complicated operations, i.e., an operation to disassemble the circuit breaker, an operation to control an interval between the contacts, and an operation to reassemble the circuit breaker. Details thereof will be explained below.

As a prior art of the ring main unit circuit breaker, Korean Registration Patent No. 10-1119734 ("MAIN CIRCUIT BREAKER FOR RING MAIN UNIT") may be referred.

FIG. 1 is a perspective view of a ring main unit circuit breaker in accordance with the conventional art. FIG. 1 illustrates an entire appearance of a ring main unit circuit breaker where a vacuum interrupter 107 has been installed in a vertical direction, and an energy transmission structure. The circuit breaker includes a supporting member 103 fixedly-installed between a pair of supporting side walls 109; a rotational shaft 101 insertion-installed at the supporting member 103; a cam 102 configured to convert a rotation force of the rotational shaft 101 into a vertical force; a power transmission pin 104 which performs up-down movement by the cam 102; a movable rod 106 coupled to the power transmission pin 104; a contact spring 105 configured to provide a contact force to the movable rod 106; and a vacuum interrupter 107 having one end connected to the movable rod 106.

FIG. 2 illustrates a cam assembly configured to convert a rotation force of the rotational shaft 101 into a vertical force. The cam assembly includes a supporting member 103 configured to support the rotational shaft 101 in upper and lower directions, right and left directions, and back and forth directions; a bush 111 inserted into a body of the supporting member 103, and configured to transmit a driving force to the cam 102; and a cam 102 coupled to the bush 111 by welding.

FIG. 3 illustrates a circuit breaker re-assembled by further including a spacer 112 for compensation of a contact force which has been lost due to a pressed state of the fixed contact and the movable contact.

An operation of the conventional circuit breaker will be explained in more detail with reference to the attached drawings.

A rotation force of the rotational shaft 101, which is generated by a driving force received from a driving unit (not shown), is converted into a vertical force by the cam 102 having an inclined slot welded to the bush 111, and by the power transmission pin 104 restricted to move only in a vertical direction. Accordingly, the movable rod 106 coupled to the power transmission pin 104, and the movable electrode of the vacuum interrupter 107 which has been coupled to the movable rod 106 also move in a vertical direction. In a closing operation of the circuit breaker, the movable electrode of the vacuum interrupter 107 moves downward by receiving a vertical force. As a result, a movable contact of the movable electrode moves downward, thereby contacting a fixed contact of the fixed electrode. As the movable electrode continuously receives the vertical force, the contact spring 105 which provides a contact force is compressed. At the same time, the closing operation is completed in a state where a contact force applied to the fixed contact and the movable contact is maintained. On the contrary, if a force to maintain a closed state is removed in an open state, the movable electrode of the vacuum interrupter 107 is separated from the fixed electrode. Then the movable electrode moves upward, and the opening operation is completed.

As the closing operation and the opening operation of the circuit breaker are repeatedly performed, the fixed contact and the movable contact, formed of copper and disposed in the vacuum interrupter 107, are pressed by a mechanical impact applied thereto, and is gradually contracted. As the fixed contact and the movable contact are contracted, a contact force, applied to the fixed contact and the movable contact by the contact spring 105, is reduced to a value lower than an initial set value. For compensation of the contracted state of the fixed contact and the movable contact, the fixed electrode of the vacuum interrupter is displaced to a position higher than an initial assembly position, using the spacer 112. As the initial interval between the fixed contact and the movable contact is maintained, a contact force can be compensated.

In summary, the circuit breaker is designed so that a driving distance of the movable contact can be the sum of an interval between the fixed contact and the movable contact in an open circuit and a distance of the movable contact pressed by the contact spring. However, the contacts inside the vacuum interrupter 107 pressed by repeated opening and closing operations of the circuit breaker, to thus be contracted. As a result, an interval between the fixed contact and the movable contact is increased and thus a contact force of the contact spring 105 is decreased. In order to compensate for the decreased contact force due to the increased interval between the fixed contact and the movable contact, the circuit breaker sealed by insulating gas is disassembled in the conventional art. Also, the position of the fixed electrode of the vacuum interrupter 107 is upward moved using the spacer 112, thereby compensating the contracted length of the fixed contact and the movable contact. However, such disassembling operation of the circuit breaker, an operation to control the interval between the fixed contact and the movable contact and an operation to re-assemble the circuit beaker are complicated, and require a lot of time. Further, the circuit breaker may have a mal-operation due to the re-assembly of the circuit breaker.

SUMMARY OF THE DISCLOSURE

Therefore, an aspect of the detailed description is to provide a ring main unit circuit breaker equipped with a contact force controller, capable of controlling a contact force between contacts of a vacuum interrupter, by controlling an interval between the contacts, through a simple manual operation from outside, without having a disassembly operation.

To achieve these and other advantages and in accordance with the purpose of this specification, as embodied and broadly described herein, there is provided a ring main unit circuit breaker equipped with a contact force controller, in a circuit breaker comprising: a rotational shaft; a cam configured to convert a rotation force of the rotational shaft into a vertical force; a power transmission pin which performs up-down movement by the cam; a movable rod coupled to the power transmission pin; a contact spring configured to provide a contact force to the movable rod; and a vacuum interrupter having one end connected to the movable rod, the circuit breaker comprising: a driving shaft installed at a driving unit; a driving link which rotates by being coupled to the driving shaft; a transmission link formed to have a controllable length, and performing up-down movement with its one end coupled to the driving link; and a rotation link coupled to another end of the transmission link, and providing a rotation force to the rotational shaft.

The transmission link may include an upper rod; a lower rod; and a length controlling rod disposed between the upper rod and the lower rod, for coupling. A right screw groove may be formed at a lower end of the upper rod, and a left screw groove may be formed at an upper end of the lower rod. A right screw thread coupled to the right screw groove, and a left screw thread coupled to the left screw groove may be formed at two ends of the length controlling rod, respectively. As a body of the length controlling rod is rotated to one direction, an insertion-length of the length controlling rod into the upper rod and the lower rod may be controlled, and thus a length of the transmission link may be controlled.

A spring washer and a nut may be disposed between the upper rod and the length controlling rod, and between the length controlling rod and the lower rod, for a coupled state therebetween.

The present invention may have the following advantages.

Firstly, as the interval between the fixed contact and the movable contact is controllable through a simple manual operation from outside, in a state where the ring main unit circuit breaker is not disassembled, a contact force applied to the fixed contact and the movable contact can be easily controlled. Accordingly, the interval between the contacts can be stably controlled during manufacturing processes and normal service state.

Secondly, an operational reliability of the circuit breaker can be enhanced, and costs required to maintain and repair the circuit breaker can be reduced.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings:

FIG. 7 is a view of a transmission link, in which

FIG. 7(*a*) is a perspective view of a transmission link, and

FIG. 7(*b*) is an exploded perspective view of a transmission link; and

DETAILED DESCRIPTION OF THE DISCLOSURE

Figure 1:
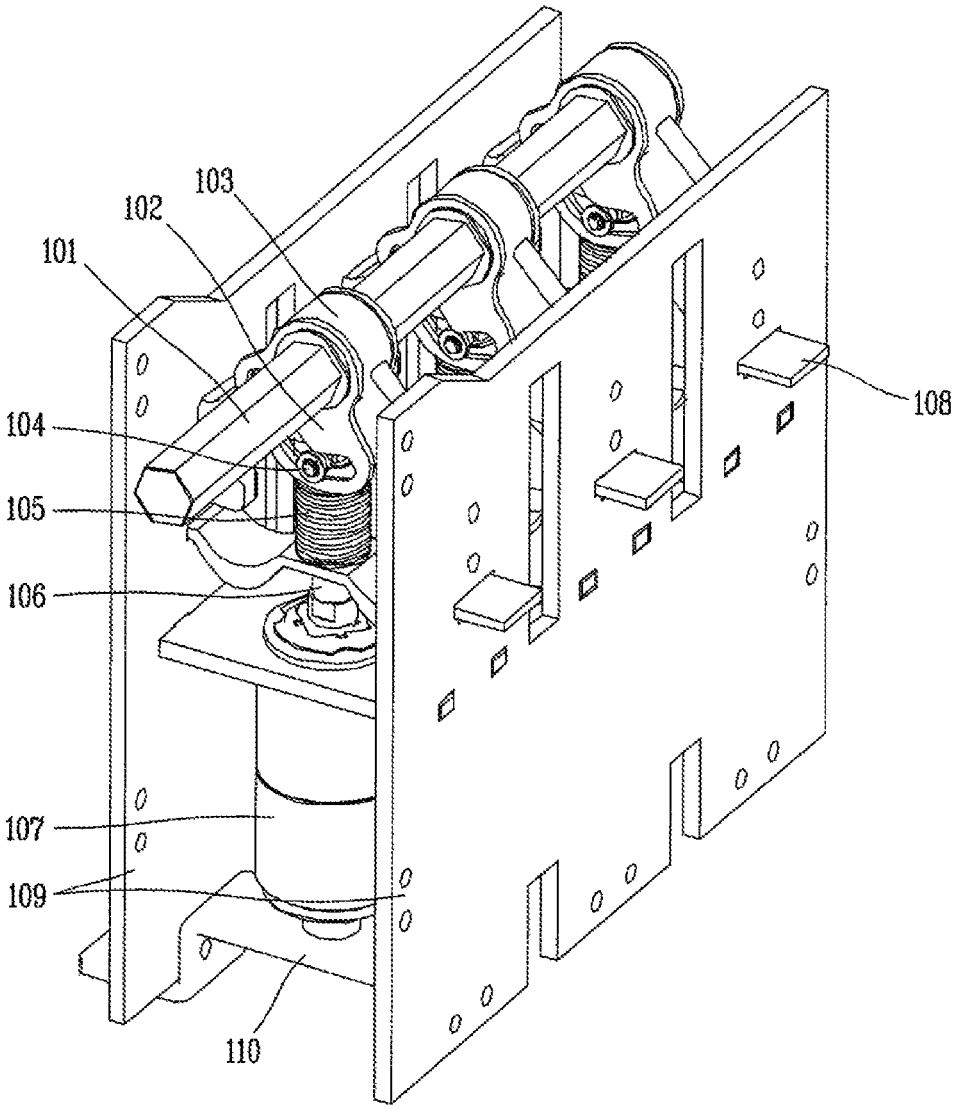
Fig. 1 Prior Art
FIG. 1 is a perspective view of a ring main unit circuit breaker in accordance with the conventional art.
Figure 2:
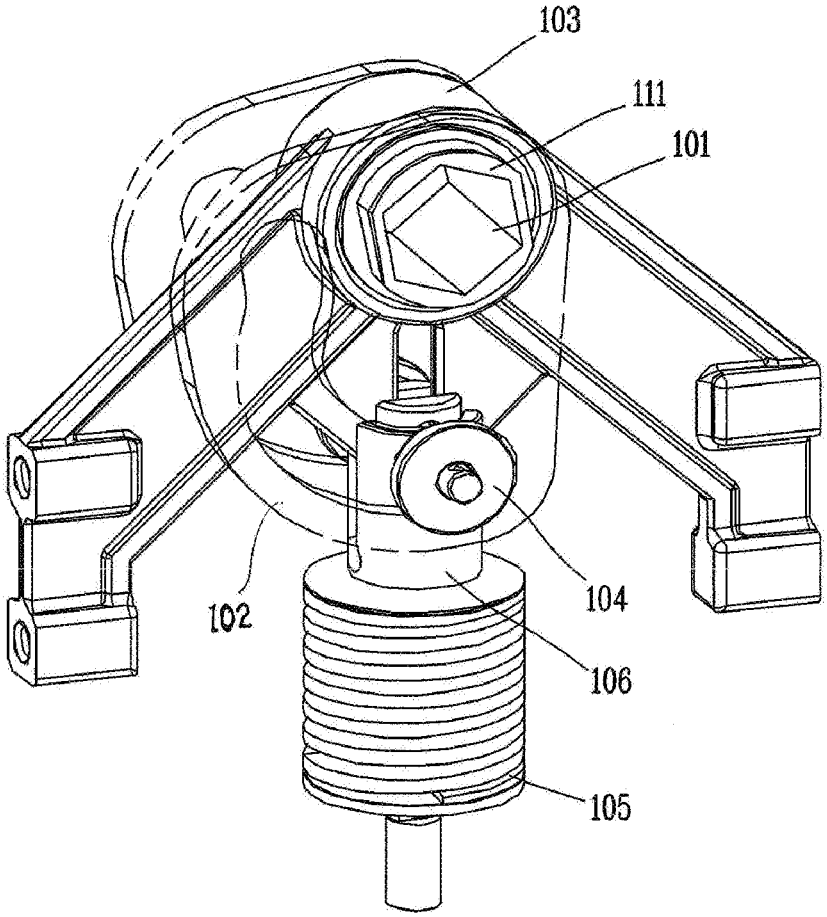
Fig. 2 Prior Art
FIG. 2 is a perspective view of a cam assembly of FIG. 1.
Figure 3:
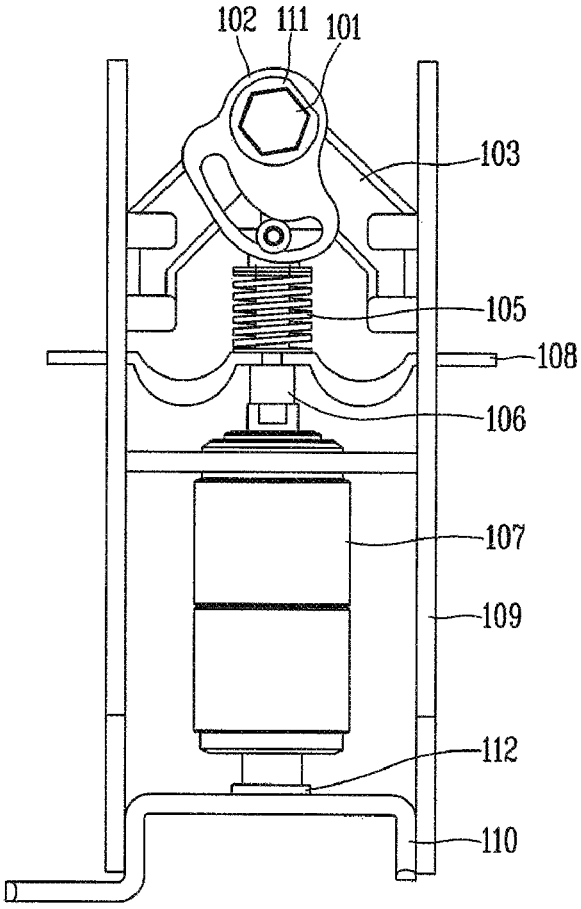
Fig. 3 Prior Art
FIG. 3 is a side sectional view illustrating a state after a ring main unit circuit breaker is reassembled in accordance with the conventional art.

Description will now be given in detail of the exemplary embodiments, with reference to the accompanying drawings. For the sake of brief description with reference to the drawings, the same or equivalent components will be provided with the same reference numbers, and description thereof will not be repeated.

A ring main unit circuit breaker equipped with a contact force controller according to an embodiment of the present invention will be explained with reference to the attached drawings.

In a circuit breaker comprising a rotational shaft 10, a cam 16 configured to convert a rotation force of the rotational shaft 10 into a vertical force, a power transmission pin 20 which performs up-down movement by the cam 16, a movable rod 25 coupled to the power transmission pin 20, a contact spring 30 configured to provide a contact force to the movable rod 25, and a vacuum interrupter 35 having one end connected to the movable rod 25, the circuit breaker comprises a driving shaft 45 installed at a driving unit 40, a driving link 50 which rotates by being coupled to the driving shaft 45, a transmission link 60 performing up-down movement with its one end coupled to the driving link 50, and a rotation link 70 coupled to an upper rod 61 of the transmission link 60, and providing a rotation force to the rotational shaft 10. The transmission link 60 includes the upper rod 61, a length controlling rod 64 and a lower rod 67, and is configured such that its length is controllable.

Figure 4:
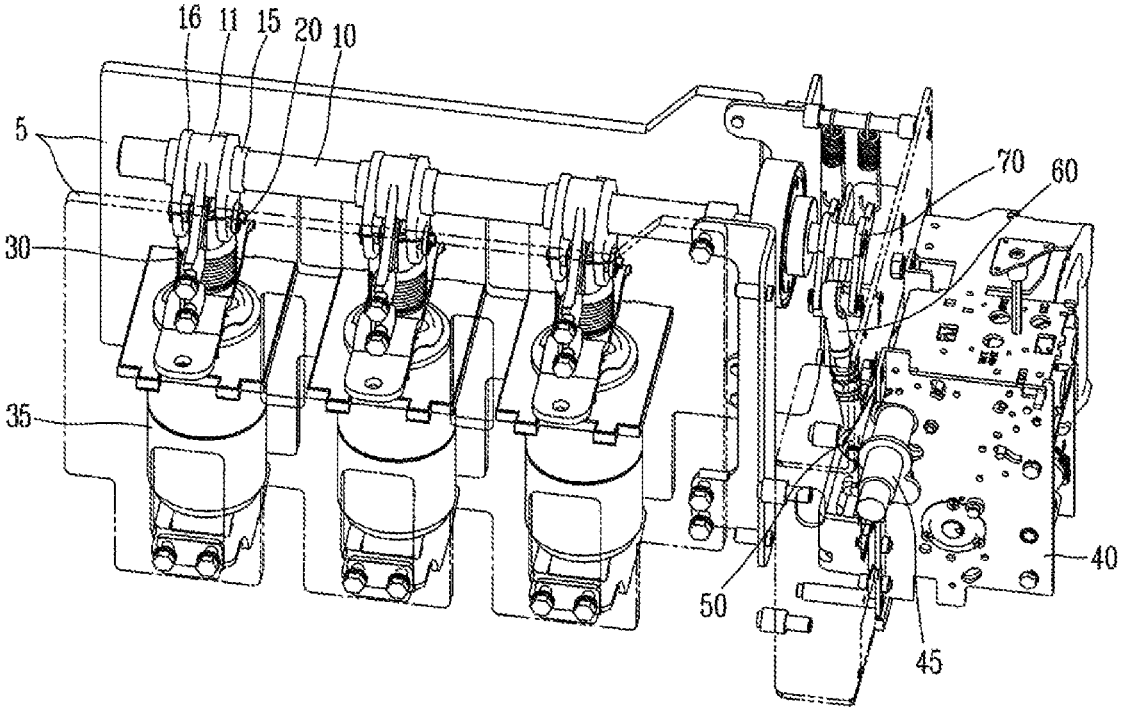
FIG. 4 is a partial perspective view of a ring main unit circuit breaker according to the present invention.
Figure 5:
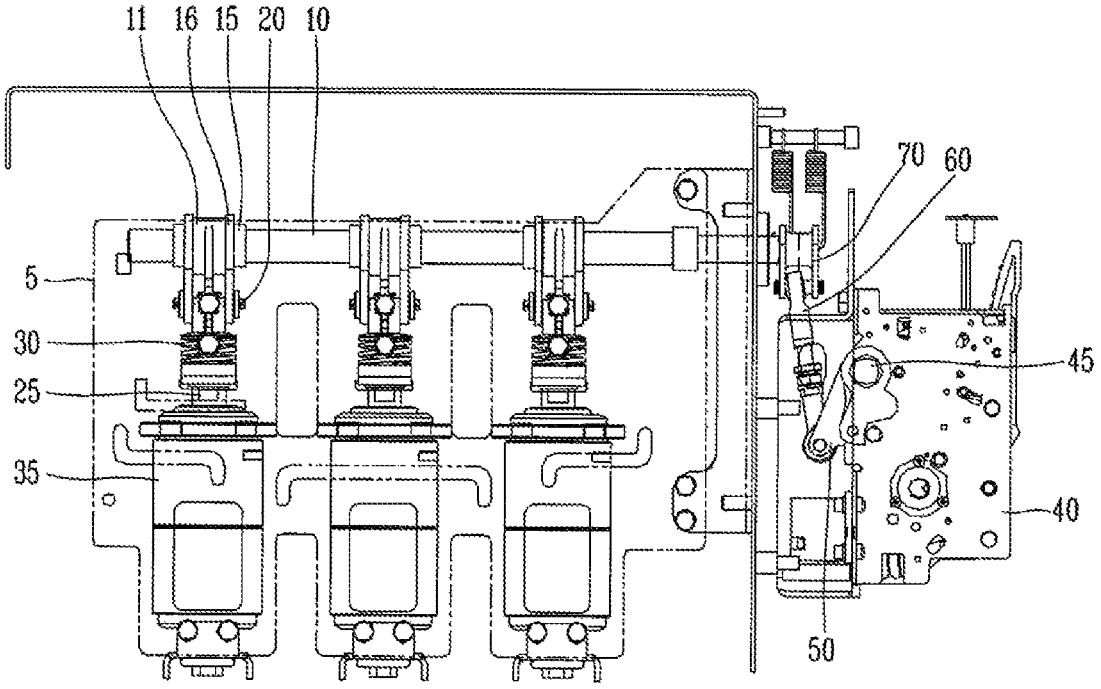
FIG. 5 is a front view of FIG. 4.
Figure 6:
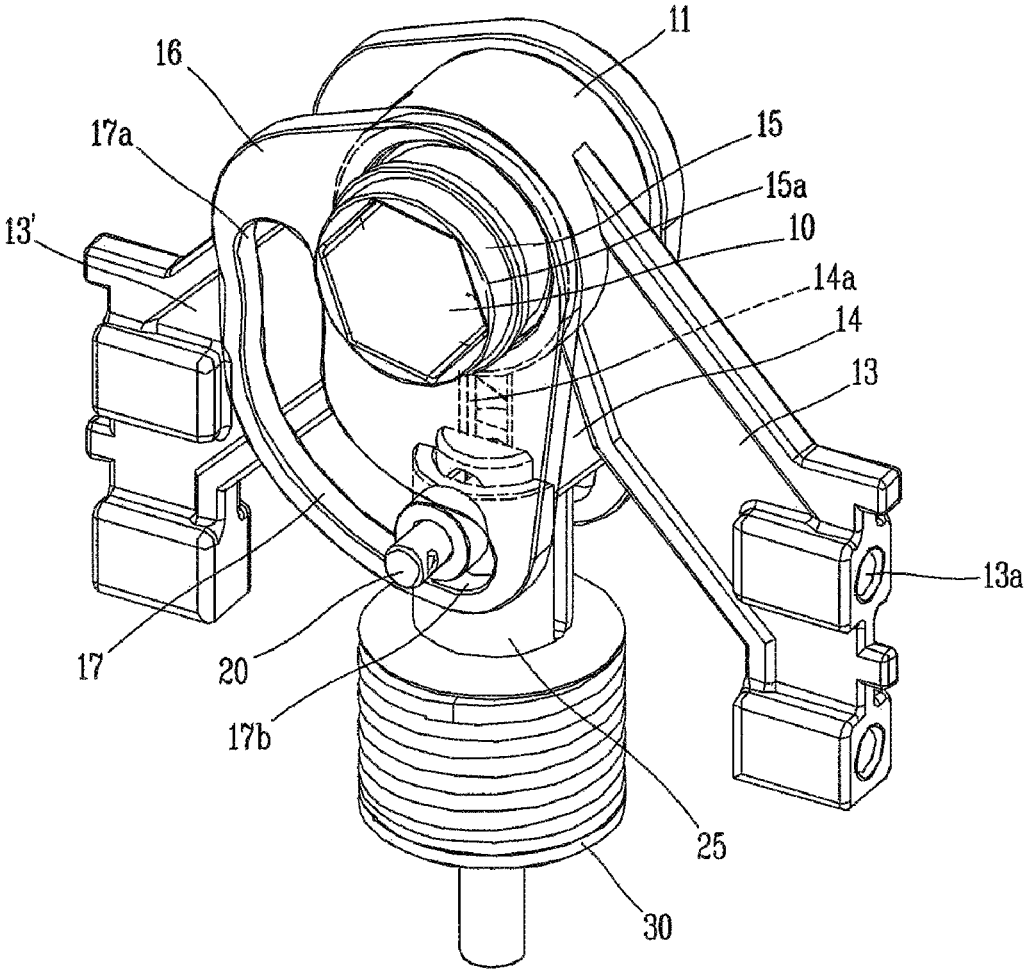
FIG. 6 is a perspective view of a cam assembly.
Figure 7:
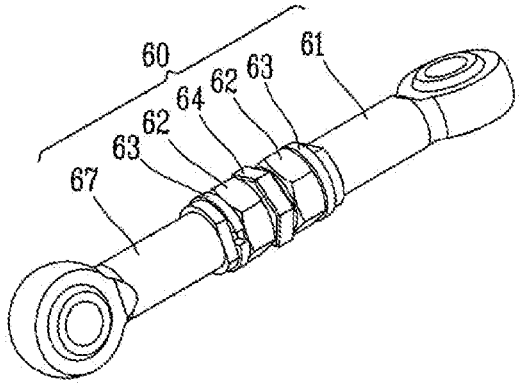
Figure 7:
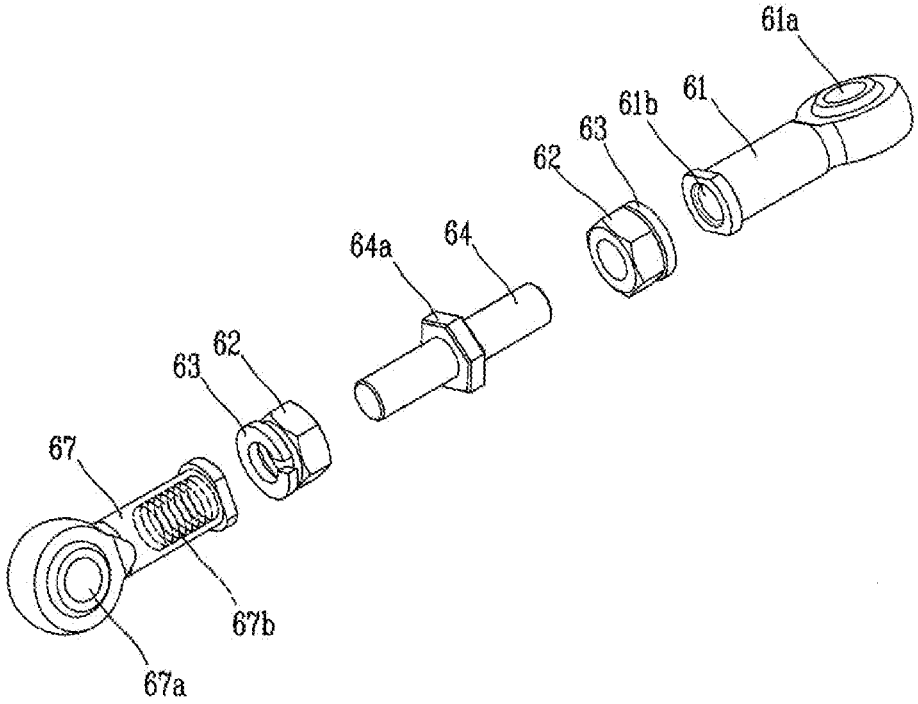

FIG. 4 is a partial perspective view of the circuit breaker of the ring main unit according to the present invention. FIG. 5 is a front view of FIG. 4. FIG. 6 is a perspective view of a cam assembly. FIG. 7(*a*) is a perspective view of the transmission link, and FIG. 7(*b*) is an exploded perspective view of the transmission link.

A pair of supporting side plates 5 are disposed to face each other, and are configured to support components of the circuit breaker of the ring main unit according to an embodiment of the present invention in a state where the plate surfaces are toward the lateral sides.

Each component including the vacuum interrupter 35 is provided in plurality in correspondence to multi-phase alternating current (AC). In this embodiment, each component is provided in three for three-phase AC. Generally, a component for a single phase is equally applied to other phases, and thus only a case of a single phase will be explained.

The vacuum interrupter 35 is disposed between the pair of supporting side plates 5, and is configured to open and close an AC circuit for each phase. A fixed electrode, and a movable electrode contacting or separated from the fixed electrode are provided in the vacuum interrupter 35.

The rotational shaft 10 is installed between the pair of supporting side plates 5, and is configured to transmit a driving force for opening and closing the vacuum interrupter 35. Such driving force is generated from the driving unit 40, and is converted into a rotation force of the rotational shaft 10 through the transmission link 60, etc. The rotational shaft 10 is rotatably installed at a supporter 11 of a cam assembly to be explained later. The cam assembly includes the supporter 11, a bush 15 and a cam 16.

The supporter 11 includes a body having a cylindrical shape; fixed leg portions 13 and 13' slantly-extending from the body toward two sides, and fixed to the supporting side plates 5; and an intermediate portion 14 formed between the fixed leg portions 13 and 13'. A plurality of coupling holes 13*a*, which can be coupled to the supporting side plate 5, may be formed at an end of each of the fixed leg portions 13 and 13'. Screws may be coupled to the coupling holes 13*a* of the fixed leg portions 13 and 13', through the supporting side plates 5. A sliding hole 14*a* is formed at a central region of the intermediate portion 14 in a vertical direction.

The bush 15 is a rotating body of a cylindrical shape, and is rotatably installed at a through hole of the body of the supporter 11. The bush 15 includes a shaft accommodating hole 15*a* for accommodating the rotational shaft 10. The shaft accommodating hole 15*a* is formed so that its sectional surface has the same shape as a horizontal sectional surface of the rotational shaft 10. Preferably, the sectional surface of the shaft accommodating hole 15*a* has a regular hexagonal shape. The bush 15 is formed to have an outer circumferential surface of a circular shape. Also, the bush 15 is formed such that its outer diameter is smaller than an inner diameter of the through hole of the body of the supporter 11. The bush 15 is rotatably installed at the through hole of the body of the supporter with a predetermined clearance. For smooth rotation of the bush 15 in the through hole of the body of the supporter 11, lubricant may be injected to the clearance between the bush 15 and the through hole of the body of the supporter 11, or a bearing may be inserted into the clearance.

The cam 16 is coupled to the bush 15 by welding, etc. so as to be rotatable together with the bush 15. The cam 16 may be formed in two so as to be attached to a front surface and a rear surface of the bush 15. A cam slot portion 17 is formed at the cam 16. The cam slot portion 17 is slantly formed from an upper side to a lower side of the cam 16, with different curvatures.

The power transmission pin 20 is installed at the sliding hole 14*a* of the supporter 11, so as to be movable up and down. A head part of the power transmission pin 20 is inserted into the cam slot portion 17, and a body part thereof is coupled to an upper end of the movable rod 25. Under such configuration, the power transmission pin 20 moves up and down as the cam 16 rotates. The power transmission pin 20 is located at a point where the sliding hole 14*a* of the supporter 11 crosses the cam slot portion 17. As the cam 16 rotates about the rotational shaft 10, a position of the cam slot portion 17, which passes through the sliding hole 14*a* from the center of the rotational shaft 10, is changed. The power transmission pin 20 moves up and down, thereby moving the movable rod 25 up and down. Accordingly, the movable electrode of the vacuum interrupter 35 contacts or is separated from the fixed electrode of the vacuum interrupter 35, thereby opening or closing a circuit.

More specifically, a rotation force of the rotational shaft 10 is converted into a vertical moving force by the cam 16 and the power transmission pin 20, thereby moving the movable rod 25 up and down. Then the movable rod 25 drives the movable electrode of the vacuum interrupter 35 to move. Under such configuration, a circuit is open or closed.

The aforementioned cam slot portion 17 may be formed to have a curvature radius which increases toward a lower side from an upper side of the cam 16. A starting part 17*a* of the cam slot portion 17, which is located at an upper side, corresponds to a circuit opening position. On the other hand, an ending part 17*b* of the cam slot portion 17, which is located at a lower side, corresponds to a circuit closing position. That is, in a case where the starting part 17*a* of the slot portion 17 is located at the sliding hole 14*a* of the supporter 11, a circuit is in an open state. On the other hand, in a case where the ending part 17*b* of the slot portion 17 is located at the sliding hole 14*a* of the supporter 11, a circuit is in a closed state. The starting part 17*a* may be upward extending with a long length. That is, the starting part 17*a* may be formed to have a length longer than that in a general driving state, with consideration of a pressed state of the fixed contact and the movable contact.

The driving unit 40 is configured to transmit a driving force generated from an operator, based on a driving mechanism. Such driving force is used to rotate the driving shaft 45 installed at one side of the driving unit 40.

The driving link 50 rotates as the driving shaft 45 rotates, because one end thereof is coupled to the driving shaft 45.

The transmission link 60 is configured as a rod. One end of the transmission link 60 is coupled to the driving link 50, and another end thereof is coupled to a rotation link 70 to be explained later. The transmission link 60 may be composed of an upper rod 61, a length controlling rod 64 and a lower rod 67. The upper rod 61 includes, at an upper part thereof, a link hole 61*a* for coupling with the rotation link 70. The upper rod 61 also includes a right screw groove 61*b* at a lower part thereof. The lower rod 67 includes a left screw groove 67*b* at an upper part thereof. The lower rod 67 also includes, at a lower part thereof, a link hole 67*a* for coupling with the driving link 50. The length controlling rod 64 is provided with screw threads at two ends thereof. The length controlling rod 64 includes, at an upper part thereof, a right screw thread to be coupled to the right screw groove 61*b* of the upper rod 61. The length controlling rod 64 also includes, at a lower part thereof, a left screw thread to be coupled to the left screw groove 67*b* of the lower rod 67. The length controlling rod 64 is provided with screw threads at two ends thereof, in a facing manner. Under such configuration, an insertion length of the length controlling rod 64 into the upper rod 61 and the lower rod 67 can be controlled by rotating a body 64*a* of the length controlling rod 64 to one direction. As a result, an entire length of the transmission link 60 can be controlled.

A nut 62 and a spring washer 63 may be disposed between the upper rod 61 and the length controlling rod 64, and between the length controlling rod 64 and the lower rod 67, for a coupled state therebetween.

The rotation link 70 is coupled to another end of the transmission link 60, more precisely, the link hole 61*a* of the upper rod 61. A coupling part of the rotation link 70, which is coupled to the link hole 61*a* of the upper rod 61, has a sufficient clearance so as to receive a force from the transmission link 60 including right and left movements of the transmission link 60. As the rotation link 70 is fixedly-installed at the rotational shaft 10, the rotation link 70 provides a rotation force to the rotational shaft 10 while moving by receiving a force from the transmission link 60.

That is, one end of the transmission link 60 is coupled to another end of the driving link 50, and another end of the transmission link 60 is coupled to the rotation link 70. The transmission link 60 moves up and down as the driving link 50 rotates. As the transmission link 60 moves, the rotation link 70 rotates clockwise or counterclockwise to thus move the rotational shaft 10. If a length of the transmission link 60 is controlled as the length controlling rod 64 is controlled, a set angle of the rotational shaft 10 is changed while the rotation link 70 rotates. As a result, a set angle of the cam 16 coupled to the rotational shaft 10 is also changed.

Figure 8:
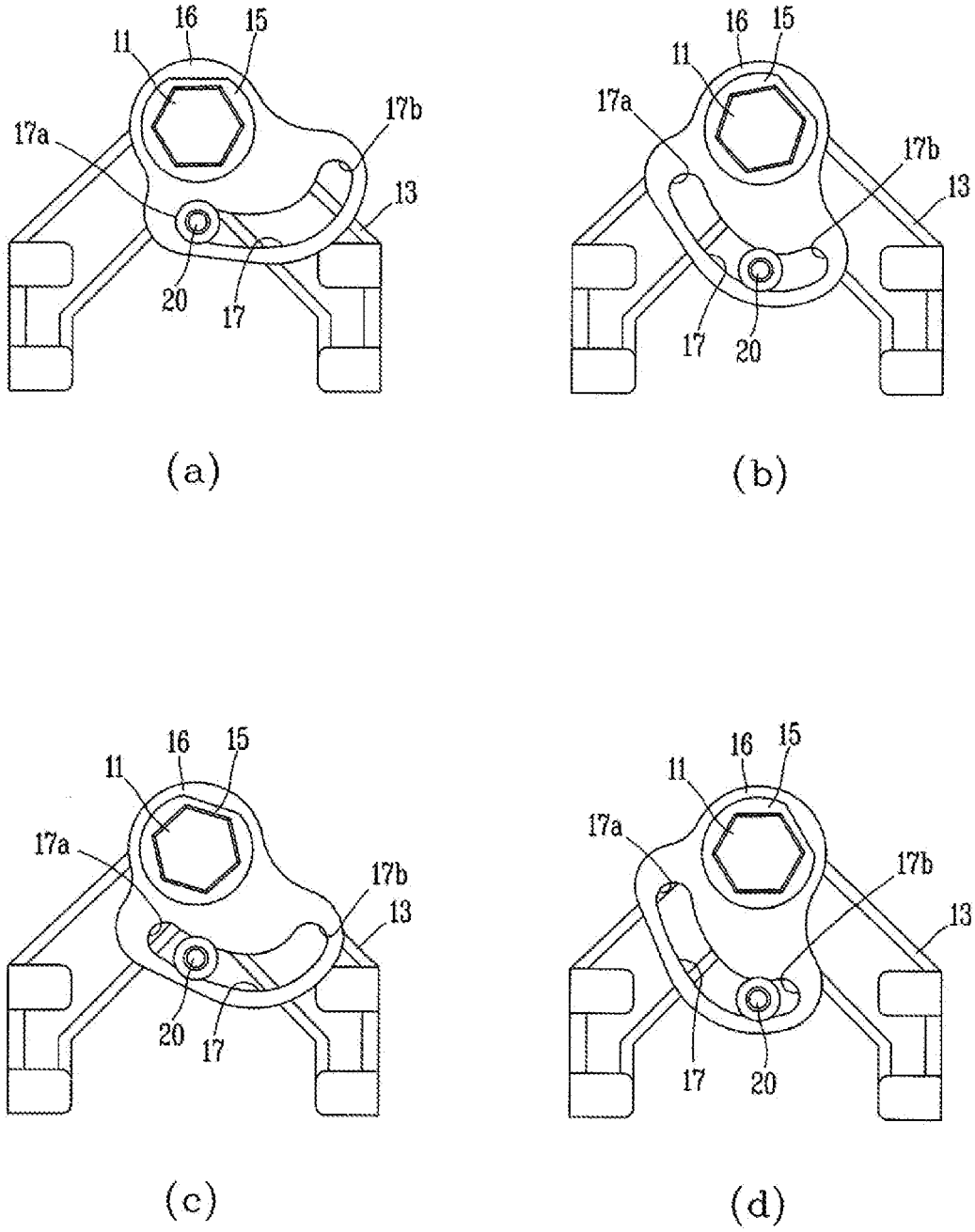
FIG. 8 is a view illustrating a position change of a cam according to a length change of a transmission link, in which FIG. 8(*a*) illustrates an open circuit in an initial state, FIG. 8(*b*) illustrates a closed circuit in an initial state, FIG. 8(*c*) illustrates an open circuit after a length of a transmission link is decreased, and FIG. 8(*d*) illustrates a closed circuit after a length of a transmission link is decreased.

An operation of the circuit breaker of the ring main unit equipped with a contact force controller according to an embodiment of the present invention will be explained with reference to FIG. 8. FIG. 8 is a view illustrating a position change of a cam according to a length change of the transmission link. More specifically, FIG. 8(*a*) illustrates an open circuit in an initial state. FIG. 8(*b*) illustrates a closed circuit in an initial state. FIG. 8(*c*) illustrates an open circuit after a length of the transmission link is decreased. FIG. 8(*d*) illustrates a closed circuit after the length of the transmission link is decreased.

A contact force of a contact spring 30 can be measured by a length of the contact spring 30. An increased length of the contact spring 30 means an increased interval between the movable electrode and the fixed electrode of the vacuum interrupter 35, which means that the movable electrode cannot easily come in contact with the fixed electrode. Accordingly, the interval between the movable electrode and the fixed electrode of the vacuum interrupter 35 can be measured by measuring the length of the contact spring 30.

If it is determined that the interval between the movable electrode and the fixed electrode of the vacuum interrupter 35 is increased since the length of the contact spring 30 is measured to be increased, the length controlling rod 64 of the transmission link 60 is rotated to reduce the length of the transmission link 60. As the length of the transmission link 60 is decreased, the cam 16 may be disposed at a position (FIG. 8(*c*)), the position obtained as the cam 16 has rotated clockwise by a certain angle from the initial position in an open state (FIG. 8(*a*)). If the rotational shaft 10 rotates by a predetermined angle in a closed state, the sliding hole 14*a* is disposed at a position of FIG. 8(*d*) where a curvature radius of the ending part 17*b* is larger than that of FIG. 8(*b*). As a result, the power transmission pin 20 is disposed at a lower side than its initial position in a closed state (FIG. 8(*b*)), and the interval between the movable electrode and the fixed electrode of the vacuum interrupter 35 is decreased (FIG. 8(*d*)). That is, an interval between a fixed contact and a movable contact of the vacuum interrupter 35 is controlled as the length of the transmission link 60 is controlled. Under such configuration, a contact force applied to the fixed contact and the movable contact by the contact spring 30 can be controlled. As aforementioned, the initial interval between the fixed contact and the movable contact can be maintained by measuring the length of the contact spring 30.

Although not shown, the starting part 17*a* of the slot portion 17 may be positioned at an upper side than a reference position of FIG. 8(*a*). That is, under an assumption that the reference position of FIG. 8(*a*) of the starting part 17*a* is a zero value (0°), the starting part 17*a* can be moved to a minus value (e.g., −5°). The reference position of the starting part 17*a* may be set to a zero value (0°), after the contacts of the vacuum interrupter 35 are pressed by repeatedly performing an opening operation and a closing operation of the circuit breaker before an actual driving.

The foregoing embodiments and advantages are merely exemplary and are not to be considered as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A ring main unit circuit breaker equipped with a contact force controller, the circuit breaker comprising:

a rotational shaft;

a cam configured to convert a rotation force of the rotational shaft into a vertical force;

a power transmission pin which performs up-down movement by the cam;

a movable rod coupled to the power transmission pin;

a contact spring configured to provide a contact force to the movable rod;

a vacuum interrupter having one end connected to the movable rod, a driving shaft installed at a driving unit;

a driving link which rotates by being coupled to the driving shaft;

a transmission link formed to have a controllable length, and performing up-down movement with its one end coupled to the driving link; and a rotation link coupled to another end of the transmission link, and providing a rotation force to the rotational shaft, wherein the transmission link includes:

an upper rod;

a lower rod; and a length controlling rod disposed between the upper rod and the lower rod, for coupling thereto, wherein a screw groove is formed at a lower end of the upper rod, wherein a screw groove is formed at an upper end of the lower rod, wherein the screw groove formed at a lower end of the upper rod and the screw groove formed at an upper end of the lower rod have opposite direction.

2. The circuit breaker of claim 1, wherein a right screw groove is formed at a lower end of the upper rod, wherein a left screw groove is formed at an upper end of the lower rod, wherein a right screw thread coupled to the right screw groove, and a left screw thread coupled to the left screw groove are formed at two ends of the length controlling rod, respectively, and wherein as a body of the length controlling rod is rotated to one direction, an insertion-length of the length controlling rod into the upper rod and the lower rod is controlled, and thus a length of the transmission link is controlled.

3. The circuit breaker of claim 2, wherein a spring washer and a nut are disposed between the upper rod and the length controlling rod, and between the length controlling rod and the lower rod, for a coupled state there between.

* * * * *